US006752288B1

(12) United States Patent
Swift

(10) Patent No.: US 6,752,288 B1
(45) Date of Patent: Jun. 22, 2004

(54) EXPANDABLE SERVING TRAY

(75) Inventor: Lawrence F. Swift, Hillsdale, MI (US)

(73) Assignee: The Swift Group of Universal Packaging, Jonesboro, MI (US)

( * ) Notice: Subject to any disclaimer, the term of this patent is extended or adjusted under 35 U.S.C. 154(b) by 0 days.

(21) Appl. No.: 10/448,654

(22) Filed: May 30, 2003

(51) Int. Cl.[7] ..... B08D 6/12
(52) U.S. Cl. ..... 220/551; 220/556; 220/666
(58) Field of Search ..... 220/666, 507, 220/551, 23.8, 556

(56) References Cited

U.S. PATENT DOCUMENTS 4,386,703 A * 6/1983 Thompson et al. ..... 206/557
4,838,444 A * 6/1989 Bitel ..... 220/4.24
4,941,585 A * 7/1990 Hare et al. ..... 220/23.2
5,052,579 A * 10/1991 Boots ..... 220/668
5,447,110 A * 9/1995 Brown ..... 141/2
5,911,338 A 6/1999 Miller ..... 220/666
6,047,848 A 4/2000 Davis ..... 220/666
6,105,815 A 8/2000 Mazda ..... 220/666
6,315,151 B1 11/2001 Hupp et al. ..... 220/666
6,334,543 B1 1/2002 Abbondandolo ..... 220/666
6,354,456 B2 3/2002 Rapson ..... 220/506
6,412,652 B1 7/2002 Woram et al. ..... 220/521
6,431,406 B1 8/2002 Pruett ..... 222/210

* cited by examiner

*Primary Examiner*—Joseph Man-Fu Moy
(74) *Attorney, Agent, or Firm*—Young & Basile, P.C.

(57) ABSTRACT

A serving tray is provided with multiple compartments, each compartment having distinct peripheral walls having a pair of bands of accordion, style pleats separated by a smooth section of wall running the entire perimeter of the walls. The bands of accordion style pleats allow the container to be folded at the pleats to compress the container to provide three volumes which are easily identifiable. The band of accordion style pleats include pleat locks which can be manually activated to prevent the band of accordion style pleats from being compressed.

12 Claims, 5 Drawing Sheets

EXPANDABLE SERVING TRAY

FIELD OF THE INVENTION

The invention relates to a multi-compartment container and particularly to a container wherein the multi-compartments are selectively collapsible and expandable.

BACKGROUND OF THE INVENTION

Various products are purchased in multi-compartment trays or containers to separate individual and distinct products from one another within the container. This is especially true in the food industry. Vegetable or fruit trays provide an array of vegetables or fruits separated in individual compartments of the tray. The vegetable or fruit tray also will generally have a dip provided in the center compartment. The quantity of the vegetable or fruit trays can vary for the size of the function where it is required. Currently, separate packaging is provided to accommodate each available size of the tray. The food vendor must maintain a significant inventory of the various size trays in his store which occupy significant storage areas. In addition, separate accounting of inventory must be maintained by the food vendor. Another disadvantage is that additional time and tooling is required in the manufacture of the various size trays.

SUMMARY OF THE INVENTION

It is the intent of the invention to address the aforementioned concerns. The invention provides a multi-compartment collapsible and expandable container, wherein each compartment has its own peripheral walls and floor forming an interior therein, and the interior of each compartment is individually collapsible and expandable.

In another aspect of the invention the multi-compartment collapsible and expandable container includes a first inner compartment and a plurality of outer compartments surrounding the inner compartment. The inner compartment is formed by a circular peripheral wall and a floor. The plurality of exterior or outer compartments are each formed by a plurality of peripheral walls which are spaced from the peripheral wall forming the other compartments. Each of the peripheral walls of the outer compartments terminate at a level plane and form a surface for engagement with a sealing lid.

In another aspect of the invention, all of the peripheral walls have a portion formed into a band of accordion style pleats to allow the container to be compressed to provide a smaller volume capacity.

In yet another aspect of the invention, the band of accordion style pleats includes a pleat lock which when manually activated, prevents the band of accordion style pleats from being compressed.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
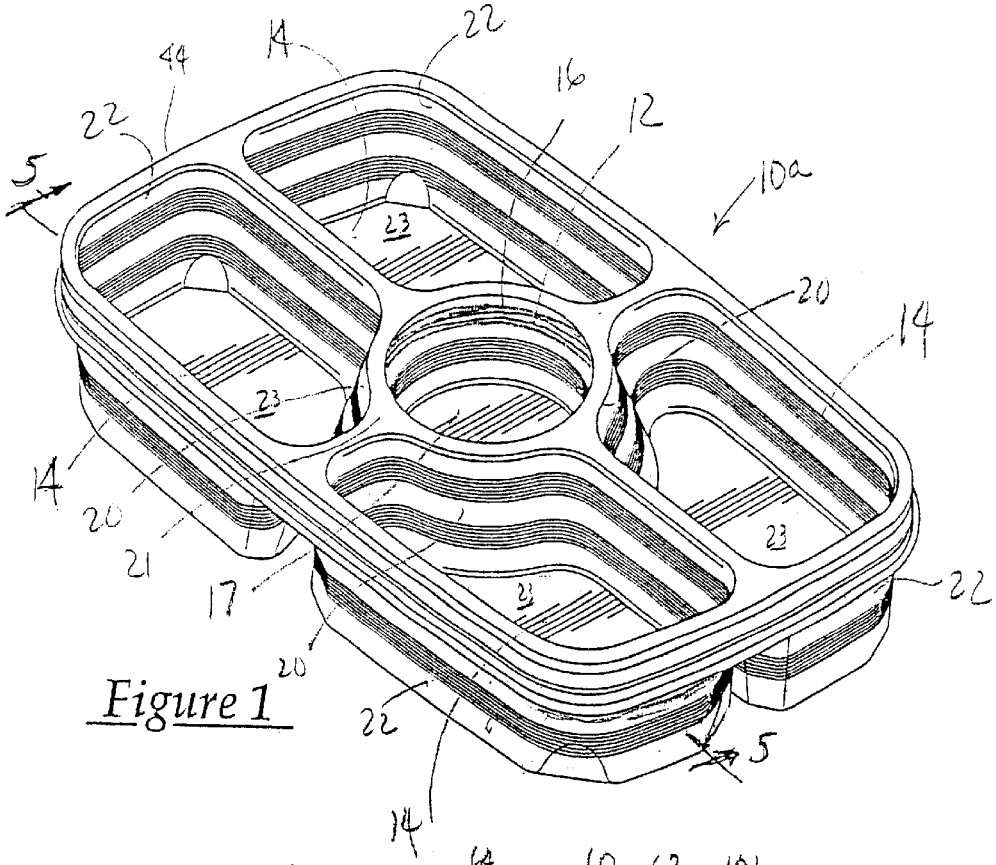
FIG. 1 is a perspective view of an oval shaped multi-compartment expandable and compressible container of the present invention having a center compartment and four exterior compartments.
Figure 2:
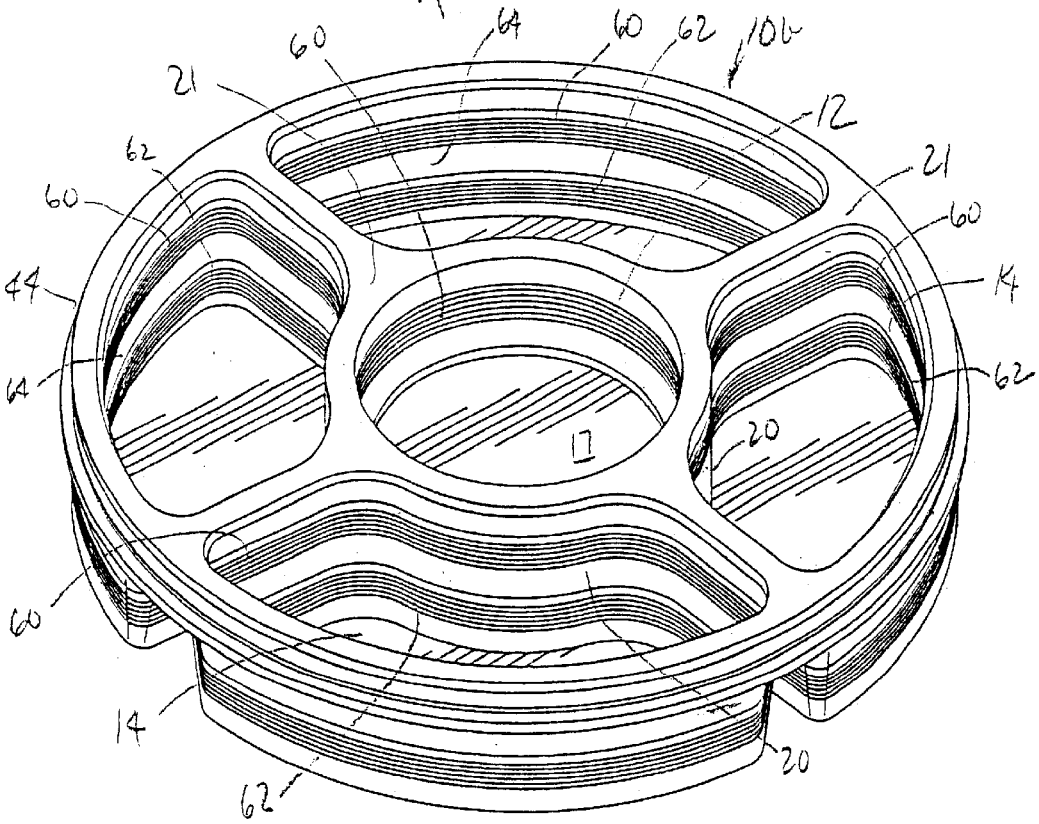
FIG. 2 is a perspective view of a round multi-compartment expandable and compressible container of the present invention having a center compartment and four exterior compartments.
Figure 3:
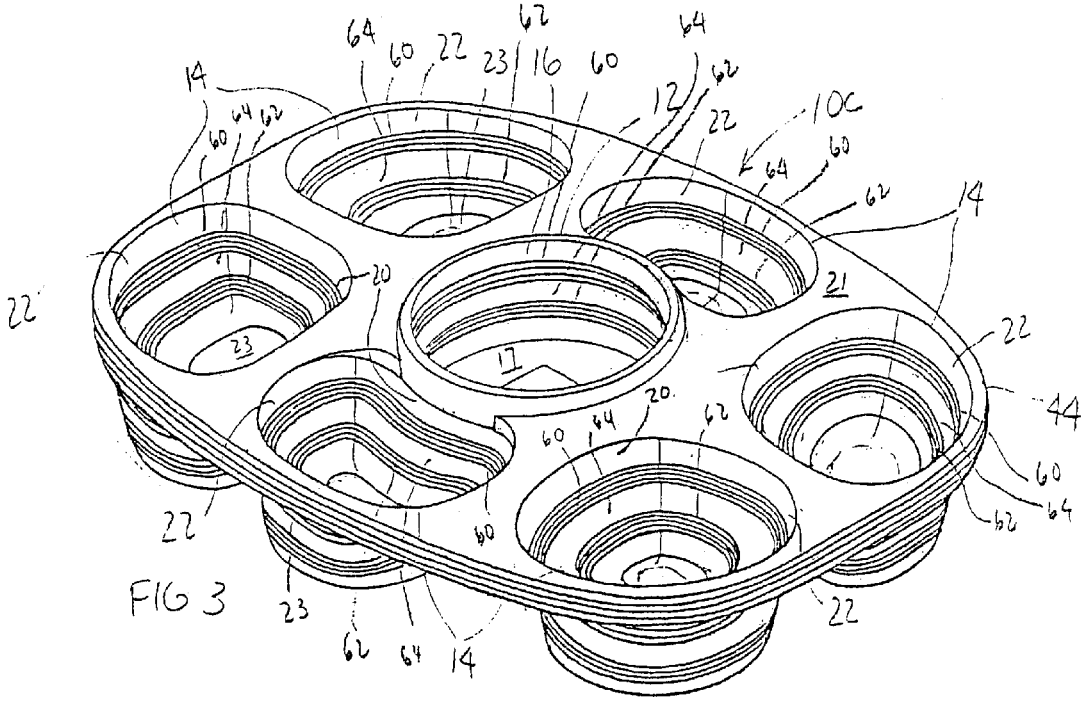
FIG. 3 is a perspective view of an oval-shaped, multi-compartment, expandable and compressible container of the present invention having a center compartment and six exterior compartments.

FIGS. 1–3 show different configurations of a multi-compartment container or tray 10*a*–*c* embodying the present invention. Each tray 10*a*–*c* has a center interior compartment 12. Although the center interior compartment 12 is usually circular for receiving dip containers, the center compartment 12 may be other shapes according to the requirements of the retailer or food vendor. The center compartment 12 is formed by a peripheral wall 16 contiguously and integrally joined at a bottom edge to a floor 17. The center compartment 12 is surrounded by multiple exterior compartments 14. Each exterior compartment 14 is formed similarly to the center compartment 12 in that each exterior compartment 14 is formed by peripheral walls 22 contiguously and integrally joined along their bottom edges with a floor 23. A portion of the peripheral wall 22 forming the exterior compartments is adjacent to the peripheral wall 16 of the center compartment 12. The portion of the peripheral wall of the exterior compartment 14 that is adjacent to the center compartment 12 is designated as 20. The adjacent peripheral wall portion 20 of each of the exterior compartments 14 is spaced from the peripheral wall 16 of the interior or center compartment 12. The adjacent peripheral wall portion 20 only connects with the peripheral wall 16 of the interior at the upper face 21. As can be seen in FIGS. 1–3, the individual compartments 12 and 14 are connected to each other only at the upper face 21.

Figure 5:
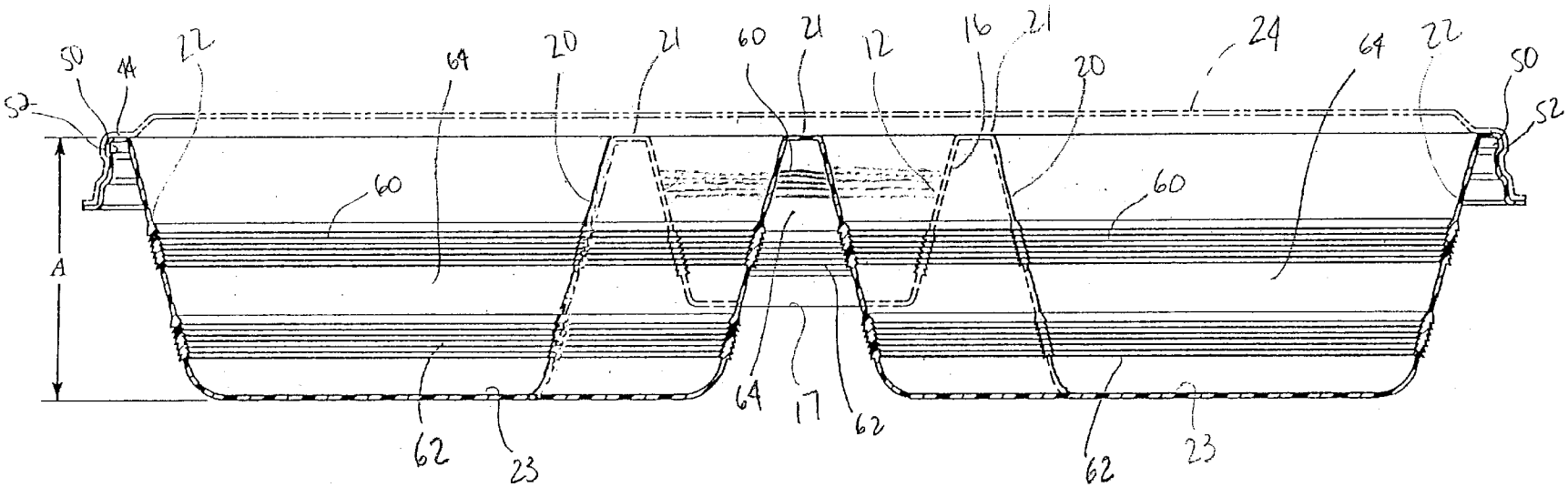
FIG. 5 is a sectional view of the multi-compartment container of FIG. 1 taken along lines 5—5.

A removable lid 24 may be provided to substantially cover the opening to the individual compartments 12, 14. The lid 24, shown in phantom in FIG. 5, has the general shape of the outer periphery of the upper face 21 of the container or tray 10*a*. The lid 24 is conventional and will generally provide a closure for the outer periphery 44 of the tray at the upper face 21. In one embodiment, the lid may have a groove 50 for receiving a portion of the outer periphery 44 of the tray 10*a*. The outer periphery 44 of the tray 10 is also conventional and may be provided in one embodiment with a sealing ridge 52 extending therefrom along a peripheral surface 54 of the rim 21. The sealing ridge 52 will meetingly engage with a groove 50 along the outer periphery 52 of the lid 24. The engagement will form an essentially tight closure or seal between the groove 50 and the ridge 52 to prevent spillage or contamination of the produce stored within the tray or container 10*a–c*. Although one configuration of a closure of a lid 24 is shown in FIG. 5, it is evident that other lid closure configurations known in the art may be incorporated in the container 10*a–c*.

Each peripheral wall 16, 22 of both the center compartment 12 and the exterior compartments 14 include at least one band 60 of accordion style pleats positioned parallel to the upper face 21 of the container 10. The band 60 of accordion style pleats are spaced from both the upper face 21 and floors 17 and 23 of the center compartment 12 and exterior compartments 14, respectively. For manufacturing purposes, it is preferred that the band 60 of accordion style pleats is spaced the same distance from the upper face 21 for each compartment 12 and 14. However, since each compartment 12 and 14 does not share a peripheral wall with any other compartment, the band 60 accordion style pleats can be independently positioned. It is imperative that when the band 60 of the accordion style pleats is fully retracted or collapsed, the height A of the trays 10*a–c* are the same for each exterior compartment 14 in order to provide a level surface for secure placement on a horizontal surface. The center compartment 12 should have a height less than or equal to the height A in order to accept the lid 24.

Figure 6:
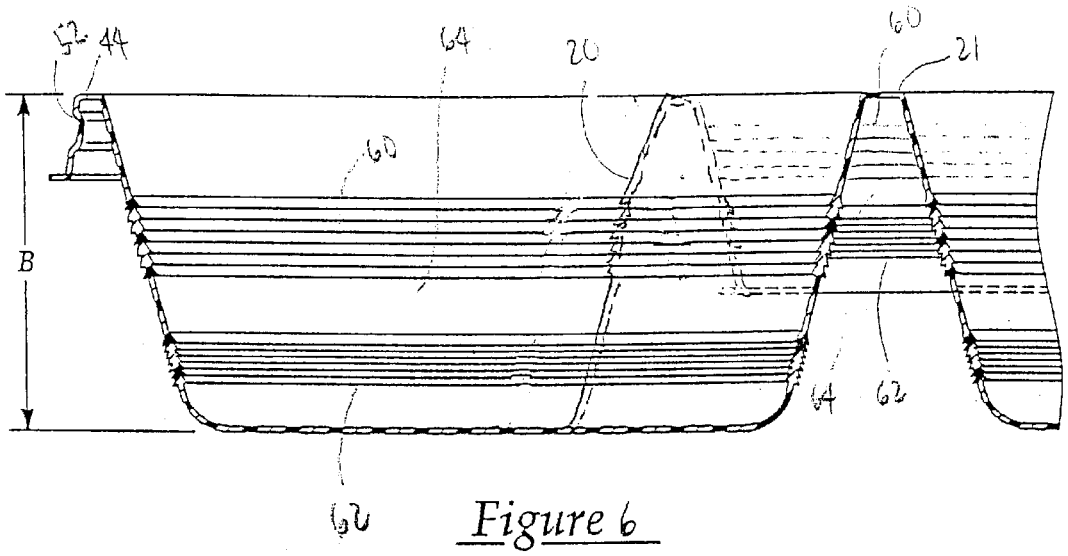
FIG. 6 is a portion of the container of FIG. 5 shown partially compressed.
Figure 7:
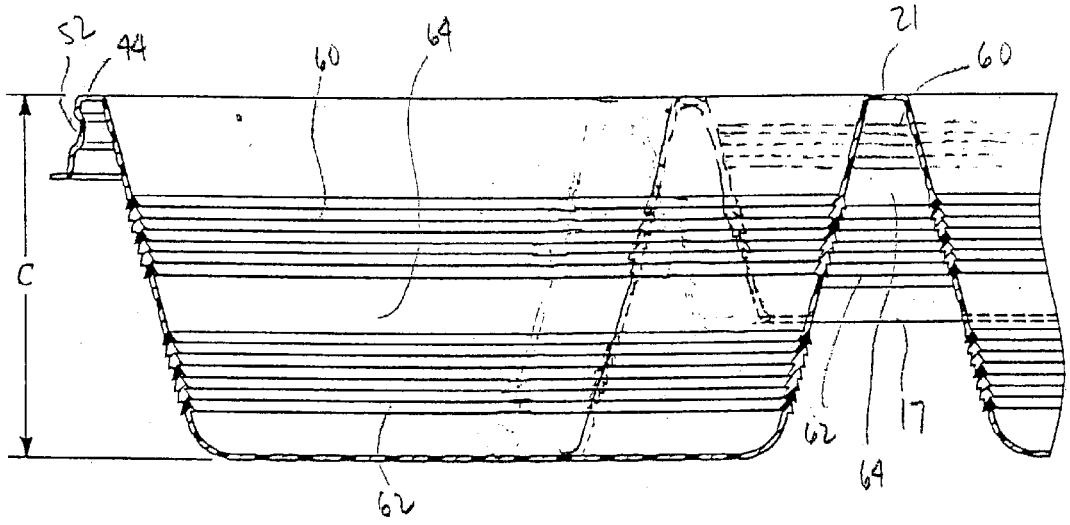
FIG. 7 is a partial sectional view of FIG. 5 showing the container fully expanded.

Although a single band 60 of accordion style pleats can provide various volumes for the multi-compartment containers 10*a–c*, there is no indicator to the retailer or food vendor what the volume capacity of a particular tray 10*a–c* is. This is especially important if the retailer or food vendor wants to advertise various size trays, such as small, medium, and large. Therefore, in order to provide an indicator for each of the three volume capacities, the present invention provides two bands 60, 62 of accordion style pleats for each compartment 12 and 14 running parallel to the upper face 21 and floors 12 and 23 respectively of the container 10*a–c*. The two bands 60, 62 of accordion style pleats are separated by a band of smooth wall 64. If neither band of accordion style pleats is expanded, the tray 10*a–c* has a small capacity, as shown in FIG. 5, with a height A. If one of the bands 60 or 62 is expanded, the tray 10*a–c* has a medium capacity, as shown in FIG. 6, with a height B. When both bands 60 and 62 of the accordion style pleats are expanded, the tray 10*a–c* has a large capacity, as shown in FIG. 7, with a height C. As is clearly shown in the drawings, the height B of the trays 10*a–c* is greater than the height A; and the height C of the trays 10*a–c* is greater than the height B. In addition, as shown in FIG. 2, the interior compartment 12 may have only one band 60 of accordion style pleats, while the exterior compartments have two bands 60, 62 of accordion style pleats.

Figure 8:
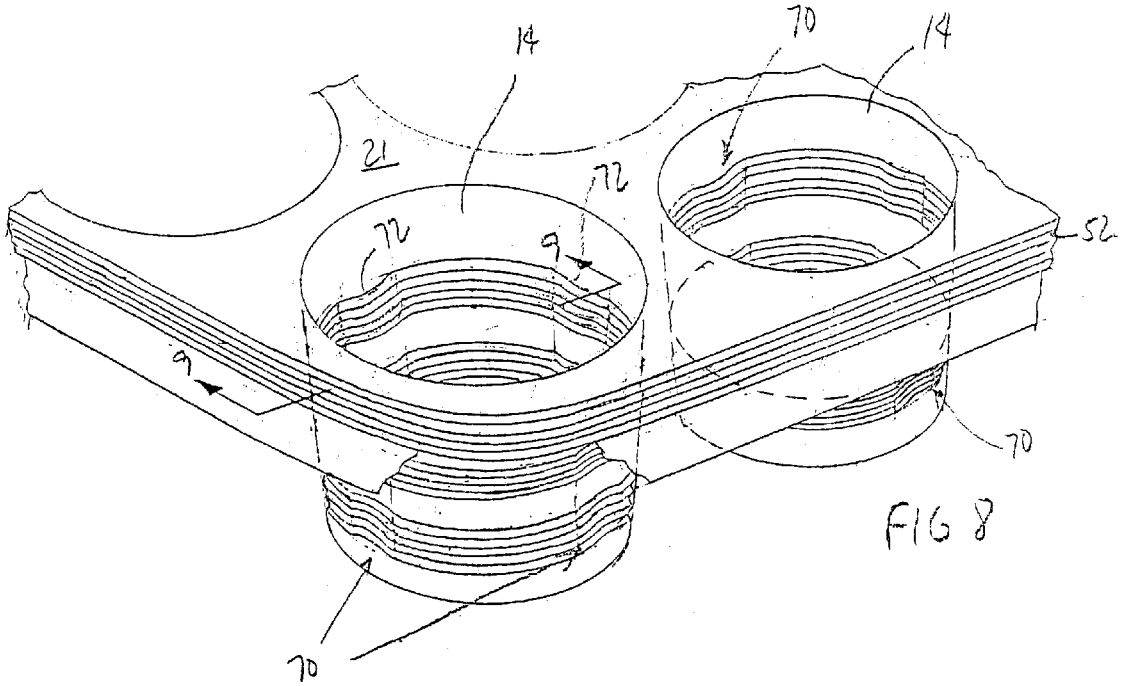
FIG. 8 is a perspective view of a portion of a multi-compartment tray illustrating another embodiment of the invention.
Figure 9:
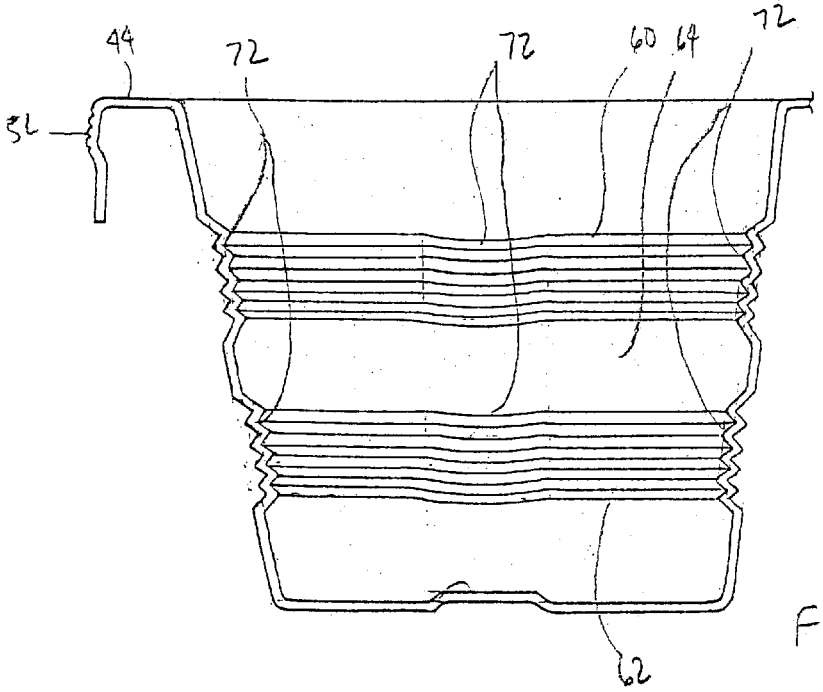
FIG. 9 is a sectional view of FIG. 8 taken along lines 9—9.

For manufacturing purposes, it is preferred to manufacture the trays 10*a–c* with the two bands 60, 62 of accordion style pleats in the expanded position. The trays 10*a–c* are shipped to the retailer or vendor with the two bands 60, 62 of accordion style pleats expanded. The retailer can optionally compress the tray 10*a–c* to the desired volume size by applying pressure to the upper face 21 with a vertically downward force. However, this downward force on the tray 10*a–c* will contract both bands 60, 62 indiscriminately. Therefore, it is further the intent of the invention to provide a locking means 70 on the bands of accordion style pleats to selectively prevent one or both bands 60, 62 of accordion style pleats from being folded when vertically downward pressure is applied to the upper face 21 of the tray 10*a–c*. FIGS. 8 and 9 illustrate the locking means 70. The locking means 70 includes at least one, but preferably four projections 72 on each band 60, 62 of accordion style pleats. The projections 72 extend into the interior of each compartment 12, 14 to allow easy access to the projections. As shown in FIGS. 8 and 9, the projections 72 are formed by a gradual convexity of the band 60, 62 of pleats at various locations of the band 60, 62. The gradual rise of the band in the interior of the compartments 12, 14 to form the projection can also be referred to as a swelling 72, since the elevation to form the projection 72 is smooth and non-abrupt relative to the remainder of the band 60, 62 of pleats. Preferably, each band 60, 62 of pleats has four projections or swellings 72. Two of the projections or swellings 72 are positioned adjacent the outer periphery of the tray or container 10*a–c*. The other two projections or swellings 72 are positioned on the opposing side of the container 12, 14. The projections or swellings 72 may also be spaced equidistance from each other.

The locking means 70 can be manually activated if the tray 10*a–c* is intended for use in the large or medium volume configuration. If the user, whether it is a retailer or food vendor, wants a medium volume tray, he would manually depress all of the projections or swellings 72 along only one band 60 or 62 of pleats in the interior of each compartment 12, 14. Depressing the projections or swellings 72 disrupts the pleating pattern of the band 60 or 62. Therefore, as the user applies a vertically downward force upon the upper face 21 of the tray 10*a–c*, the band 60 or 62 of pleats having the depressed projections or swellings 72 will not contract or fold and only the other band 60 or 62 in each compartment 12, 14 will fold or contract to form the medium size tray 10*a–c*.

If the user wants a large size tray, then all of the projections or swellings 72 in both bands 60 and 62 of pleats in the interior of each compartment 12, 14 would be depressed. This depression prevents any of the bands 60 and 62 of pleats from being folded. If the user wants a small size tray 10*a–c*, then none of the projections or swellings 72 would be depressed so that both bands 60, 62 of pleats could be folded upon downward pressure on the upper face 21 of the tray 10*a–c*.

Although, the drawings show each band 60 and 62 of pleats having projections or swellings 72 thereon, it would be conceivable, as an alternative, to only have the projections or swellings 72 on only one of the bands 60 or 62 of pleats in each compartment 12, 14. Depressing all the swellings 72 of the one band 60 or 62 will provide the medium capacity tray. Depressing none of the swellings 72, but then applying vertically downward pressure on the upper face 21 of the tray will provide the small capacity tray. Finally, depressing none of the swellings 72 and applying no pressure to the upper face 21 of the tray 10*a–c* will maintain the tray 10*a–c* in the large capacity configuration.

Figure 4:
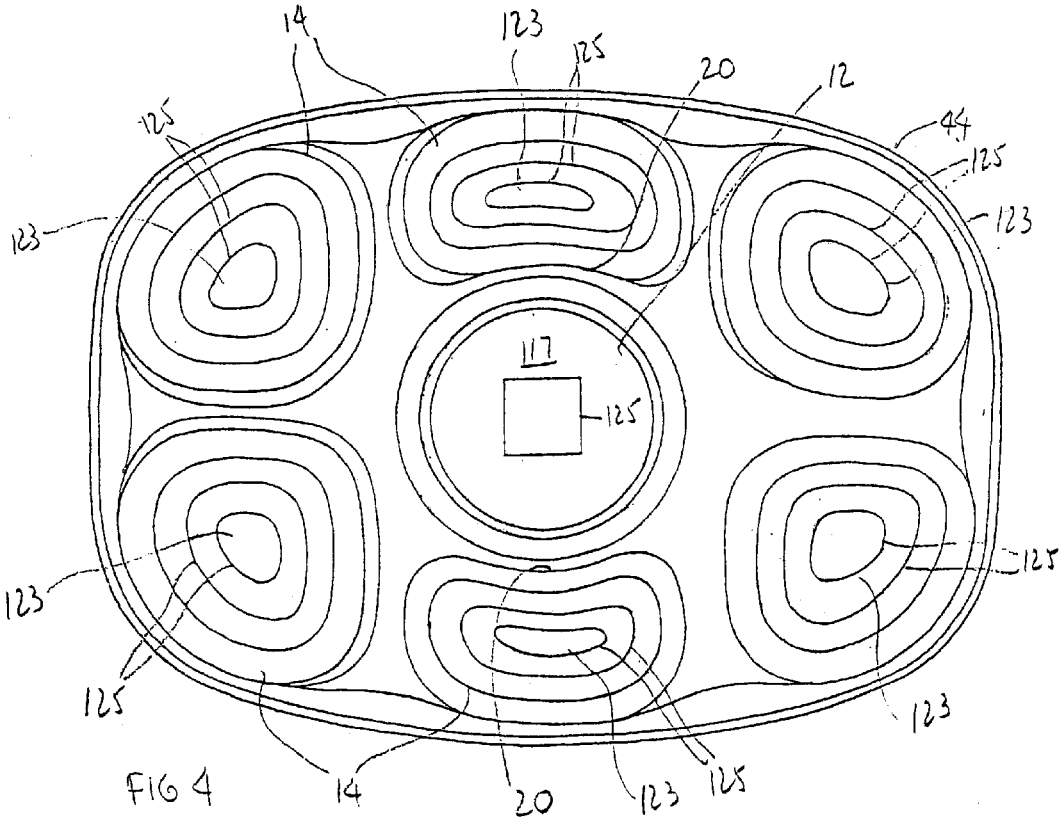
FIG. 4 is a top view of the container in FIG. 3.

FIG. 4 shows another configuration for the floors 117 and 123 of the individual compartments 12, 14. In many cases, the trays 10*a–c* of the present invention will be used for the storage of food products, such as vegetables and fruit.

These food products have high moisture contents. Therefore, it is desirable to provide a ridged floor configuration, so that any drainage of the moisture will pool at the lower level of the ridged floor so that the food product is not laying in the pool of moisture. The ridged floors 117 and 123 can have various configurations. However, it is preferable that the space between upper edges of the ridges 125 is narrower than the food product contained therein so that food portions do not sit in the pooled liquid.

The expandable and compressible tray is made of a plastic material that is compatible for storing food products. The plastic material has the rigidity to withstand the weight of the food contents, but is lightweight enough to provide a inexpensive tray that is disposable.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A multi-compartment, expandable and compressible container comprising:

a first inner compartment having a first interior formed by a first peripheral wall;

at least one outer compartment having another interior formed by a plurality of peripheral walls;

wherein the plurality of peripheral walls are spaced from the first peripheral wall and each peripheral wall terminates at a level plane having a surface engageable with a sealing lid and wherein each peripheral wall has means for selectively expanding and compressing all of the compartments.

2. The container of claim 1 further comprising means to selectively expand and contract each interior of each compartment individually.

3. The container of claim 1 further comprising means to selectively expand and contract each interior of compartment to a different volume capacity.

4. The container of claim 1, wherein the means for selectively expanding all of the compartments includes an accordion style portion in all of the peripheral walls.

5. The container of claim 4, wherein there are more than one accordion style pleat portions in all of the peripheral walls and each pleat portion is separated by a smooth portion.

6. The container of claim 1, wherein each peripheral wall has locking means for preventing the selective compressing of the compartment.

7. A multi-compartment expandable and compressible container for storing contents therein, each compartment having an interior.

8. The container of claim 7, wherein the floor is rigid.

9. The container of claim 7, wherein each peripheral wall has a pair of bands of accordion style pleats having compressible attributes.

10. The container of claim 9, wherein the at least one band of pleats has a projection directed toward the interior of the compartment.

11. The container of claim 7, wherein the floor has ridges for pooling moisture away from the contents.

12. The container of claim 9, wherein there are four projections on each band of pleats.

* * * * *